US005871094A

United States Patent [19]

Leibowitz

[11] Patent Number: 5,871,094

[45] Date of Patent: Feb. 16, 1999

[54] LAPTOP COMPUTER CASE AND STAND

[76] Inventor: Marc Leibowitz, 245 E. 84th St., apt. 2E, New York, N.Y. 10028

[21] Appl. No.: 10,916

[22] Filed: Jan. 22, 1998

[51] Int. Cl.[6] ..... B65D 85/00

[52] U.S. Cl. ..... 206/320; 108/43; 206/45.23; 248/918

[58] Field of Search ..... 248/444, 918; 108/43; 206/320, 305, 576, 45.23

[56] References Cited

U.S. PATENT DOCUMENTS 5,054,736 10/1991 Champoux ..... 248/444
5,263,423 11/1993 Anderson ..... 108/43
5,348,263 9/1994 Hubbard ..... 248/444
5,533,702 7/1996 Koch ..... 248/918 X
5,632,373 5/1997 Kumar et al. ..... 206/305
5,682,993 11/1997 Song ..... 206/320

*Primary Examiner*—Ramon O. Ramirez
*Attorney, Agent, or Firm*—Michael I. Kroll

[57] ABSTRACT

A laptop computer case and stand (10) comprising a base (12) having a compartment (14) for holding a laptop computer (16) therein. A lid (18) is hinged at (20) to the base (12). A facility (22) along a rear edge of the lid (18) is for engaging an upper surface of a pair of legs (24) of a person (26) sitting in a chair (28), when the lid (18) is opened. A component (30) on the lid (18) is for transporting the base (12) and the lid (18) by the person (26), when the lid (18) is closed, so as to be conveyed to various locations.

23 Claims, 6 Drawing Sheets

LAPTOP COMPUTER CASE AND STAND

BACKGROUND OF THE INVENTION

1. Field of the Invention

The instant invention relates generally to portable lap desks and covers and more specifically it relates to a laptop computer case and stand. The laptop computer case and stand will function as a lap stand or platform to keep the laptop computer steady, so that it will not fall off a person's lap. The laptop computer case and stand includes leg contours, so that when unfolded it will fit upon the legs of a sitting person. The laptop computer case and stand also contains a cutout carry handle or optionally a strap handle or shoulder strap. When folded up it will function as a carrying case for the laptop computer, so as to be conveniently transported.

2. Description of the Prior Art

Numerous portable lap desks and covers have been provided in prior art. For example, U.S. Pat. Nos. 5,054,736 to Champoux; 5,263,423 to Anderson; 5,348,263 to Hubbard and 5,682,993 to Song all are illustrative of such prior art. While these units may be suitable for the particular purpose to which they address, they would not be as suitable for the purposes of the present invention as heretofore described.

CHAMPOUX, BRUNO

LAPTOP READING AND WRITING STAND

U.S. Pat. No. 5,054,736

This stand is to be placed on one's lap to operatively support a book, newspaper, papers, or the like for reading or writing. This is particularly constructed and arranged to be easily actuated by the user himself while using it, which allows to conveniently position and hold a newspaper or other papers and that readily collapses flat on one's lap to form a table for writing. This stand comprises a base panel, a worktable panel and an inclination adjustment leg pivoted on the base. A series of stoppers are against the back of the worktable panel and are selectively engageable by the free outer end of the leg. A work holder bar assembly is to conveniently hold and position a book, newspaper, papers, or the like.

ANDERSON, ROLF

ARTICLE SECUREMENT DEVICE

U.S. Pat. No. 5,263,423

A securement device for releasable attachment of a laptop computer or other article to a user's leg includes a table member and a pair of in-folding leg members, one each of which is attached for hinged movement relative to a corresponding side edge portion of the table member. Elastic webbing interconnects the free end portion of each leg member to a central portion on the underside of the table member. The securement device is centered on a user's leg and a pair of co-acting straps are used to snugly encircle the user's leg to prevent pivotal movement of the securement device relative thereto. The leg members brace the table member to prevent displacement thereof as a result of ordinary unbalanced imposed forces. Elastic straps are provided whereby an article such as a laptop computer may be releasably attached to the supporting surface of the table member. The securement device allows a user of a laptop computer to stand and walk a few steps without displacing the laptop computer. When removed from a user's leg, the securement device folds to a compact storage position.

HUBBARD, FRANK M.

PORTABLE EXPANDABLE LAP DESK

U.S. Pat. No. 5,348,263

This invention relates to a portable expandable desk comprising a first substantially rigid flat surface member and a second substantially rigid flat surface member. A means is for hingedly attaching the first surface member to the second surface member, so that the first and second surface members are capable of folding together. A means is for bracing the first surface member and the second surface member in an unfolded position. The bracing means comprises a gripping means to prevent the bracing means from inadvertently disengaging from the first or second surface member.

SONG, KWANG-HO

MULTIPURPOSE COVER FOR A NOTEBOOK PERSONAL COMPUTER

U.S. Pat. No. 5,682,993

A multipurpose cover for transporting and protecting a portable person computer is formed by upper and lower rectangular trays joined by a zipper. The computer remains attached to and partially enclosed by the trays while being operated, and may be conveniently connected to an external printer, monitor or other peripheral device through apertures formed in at least one of the rectangular trays. Elastic flaps equipped with snap fasteners cover the apertures when not in use, and rubber struts may be attached to the bottom of the lower tray to control the angle of the keyboard. A company name or logo may be embossed on an external surface of the cover for advertising purposes.

SUMMARY OF THE INVENTION

A primary object of the present invention is to provide a laptop computer case and stand that will overcome the shortcomings of the prior art devices.

Another object is to provide a laptop computer case and stand that will function as a lap stand or platform to keep the laptop computer steady, so that it will not fall off a person's lap.

An additional object is to provide a laptop computer case and stand that includes leg contours, so that when unfolded it will fit upon the legs of a sitting person, while it also contains a cutout carry handle or optionally a strap handle or shoulder strap, whereby when folded up it will function as a carrying case for the laptop computer, so as to be conveniently transported.

A further object is to provide a laptop computer case and stand that is simple and easy to use.

A still further object is to provide a laptop computer case and stand that is economical in cost to manufacture.

An additional further object is to provide a laptop computer case and stand that can also function as a reading and writing desk, an activity desk, a painting desk or any other type of desk.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 2:
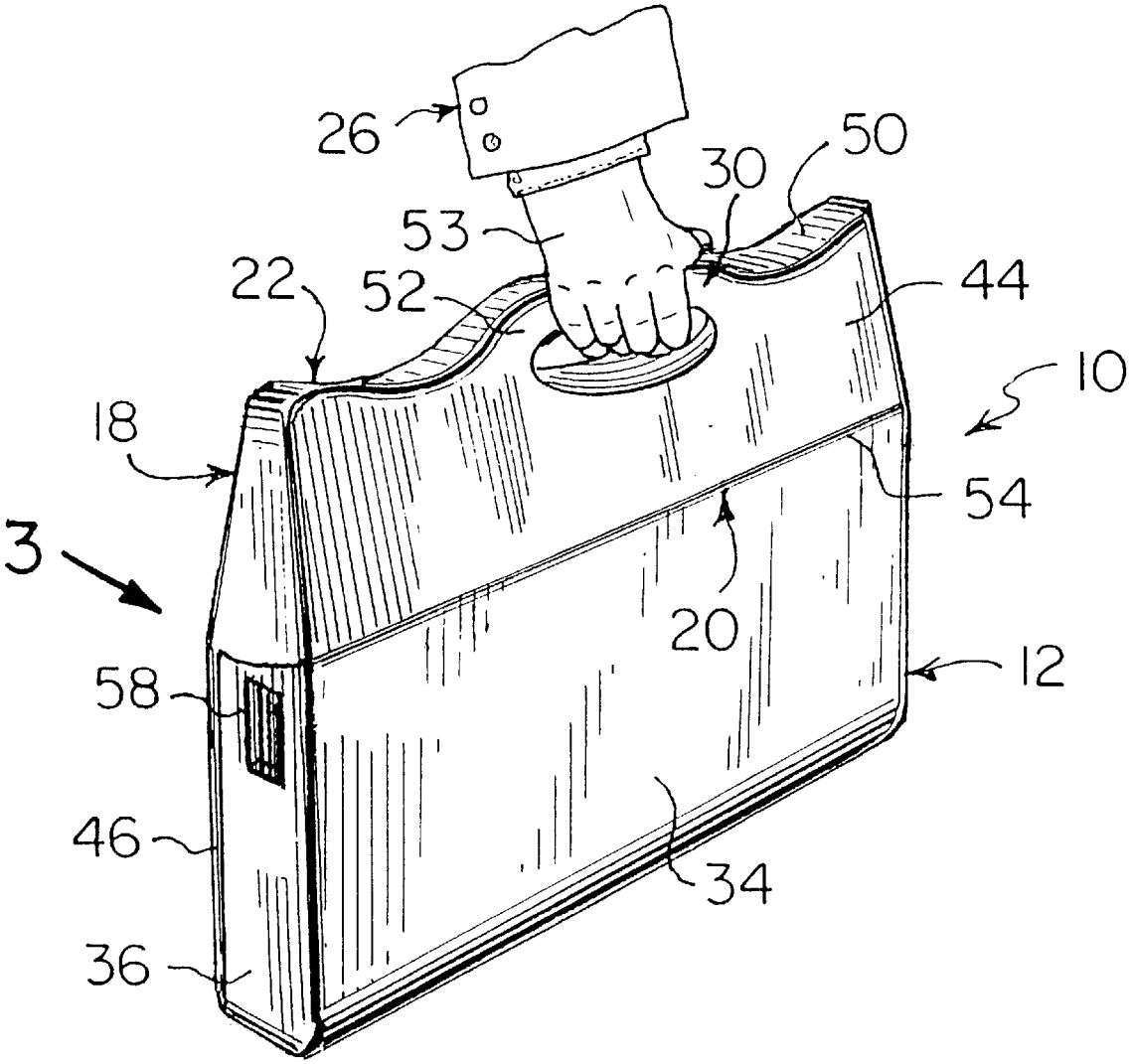
FIG. 2 is a rear perspective view of the present invention closed, with the cutout carry handle being gripped by a hand of a person to function as a carrying case.
Figure 2A:
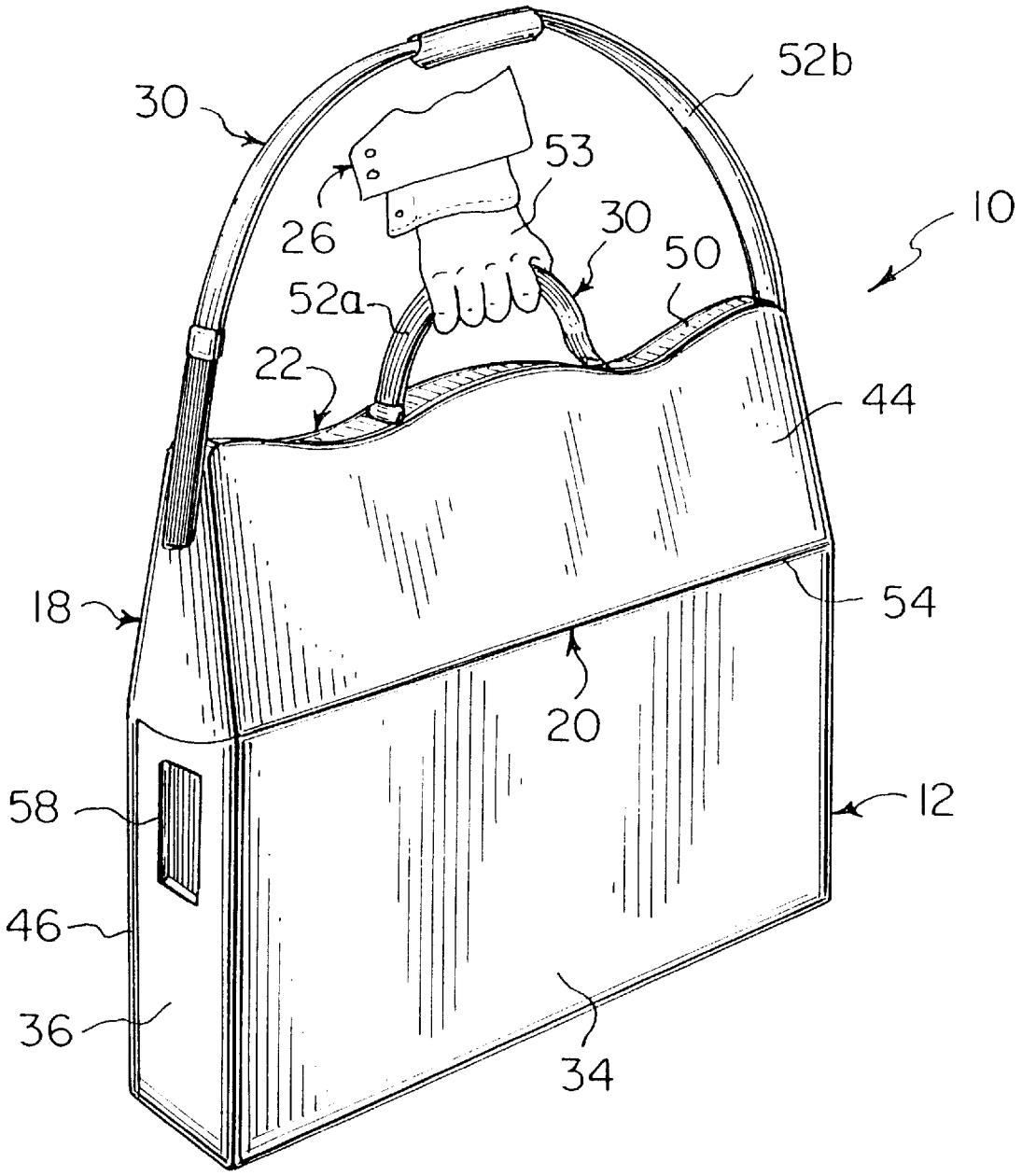

FIG. 2*a* is a rear perspective view similar to FIG. 2, showing the strap handle being gripped by the hand of the person and also a shoulder strap attached thereto.

Figure 3:
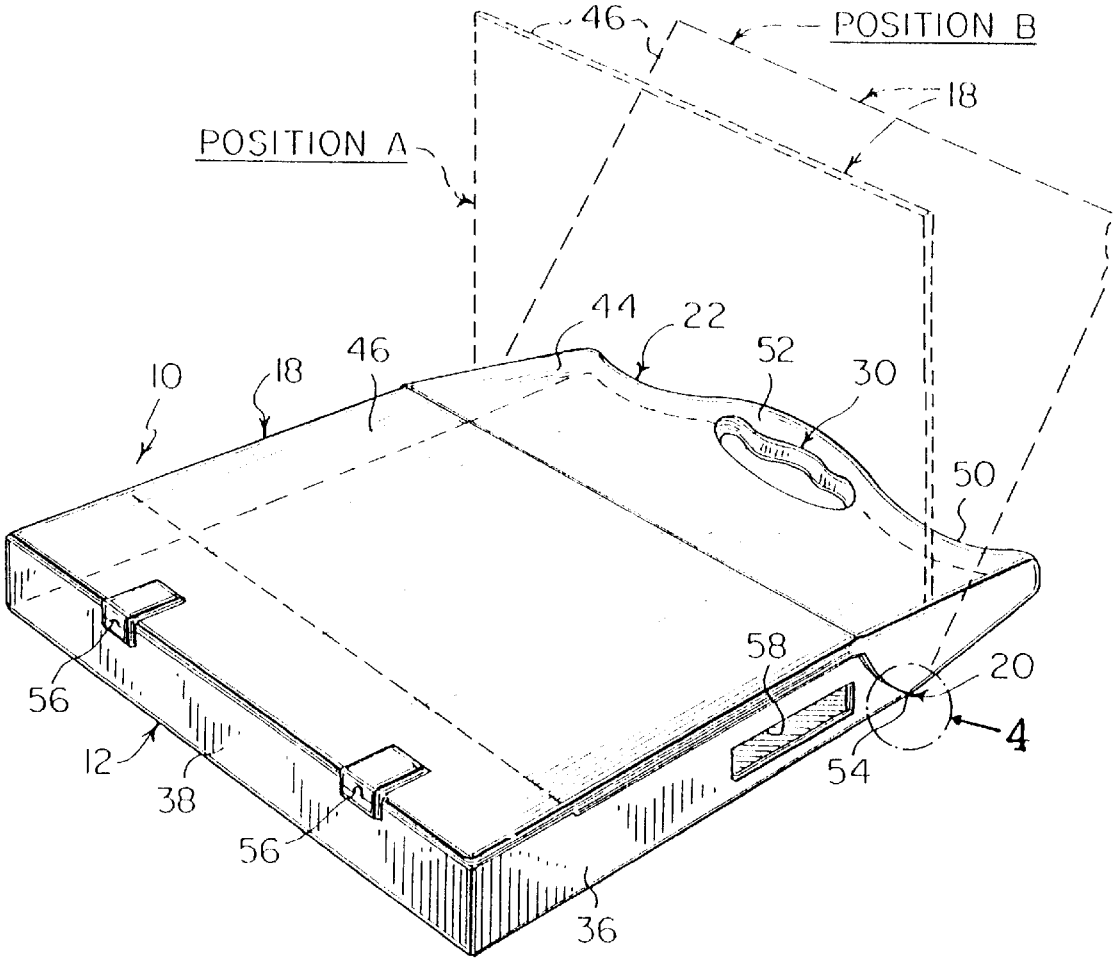

FIG. 3 is a front perspective view of the present invention per se taken in the direction of arrow 3 in FIG. 2.

Figure 4:
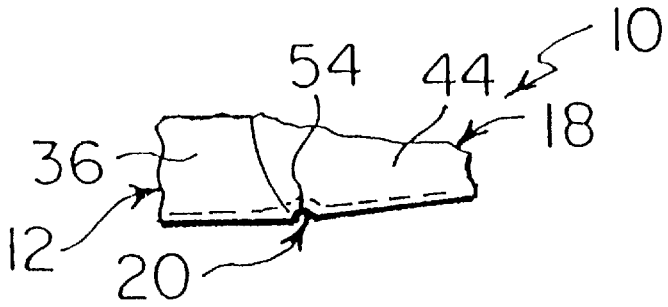

FIG. 4 is an enlarged side view of an area in FIG. 3 indicated by arrow 4, showing the hinge in greater detail.

Figure 5:
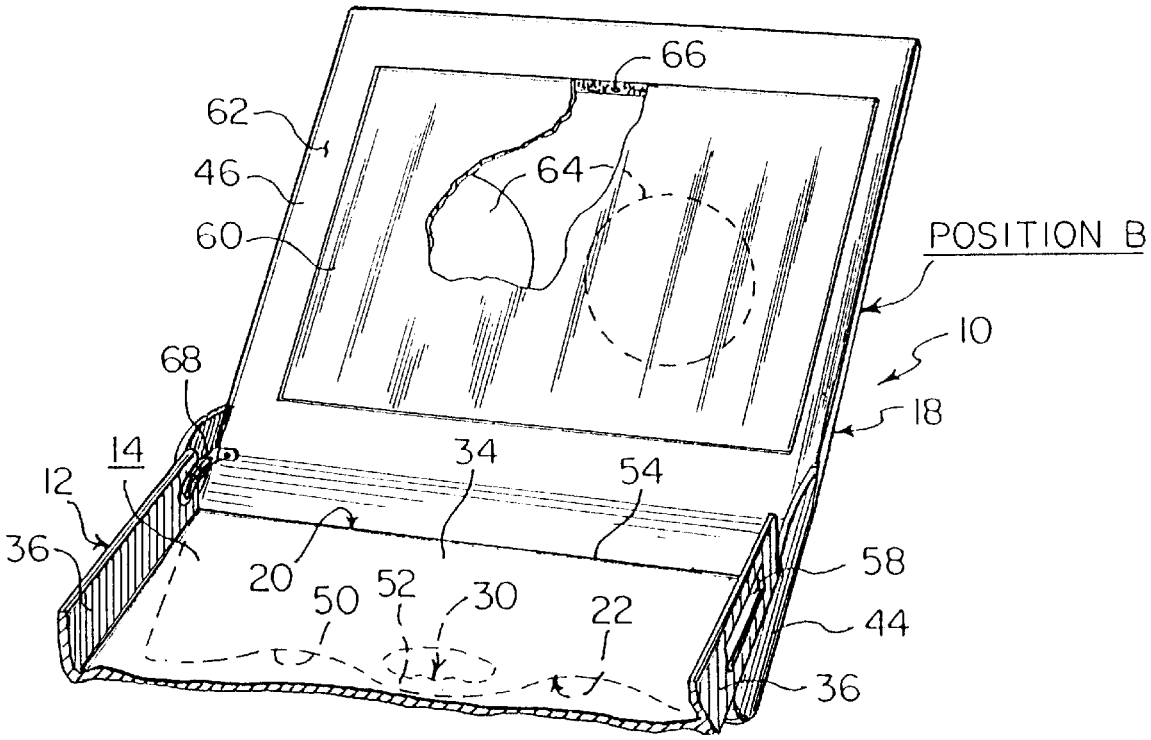

FIG. 5 is a front perspective view of the present invention per se opened, with parts broken away and in section, showing a VELCRO sealed pocket under the lid for holding computer disks, papers and files therein.

Figure 1:
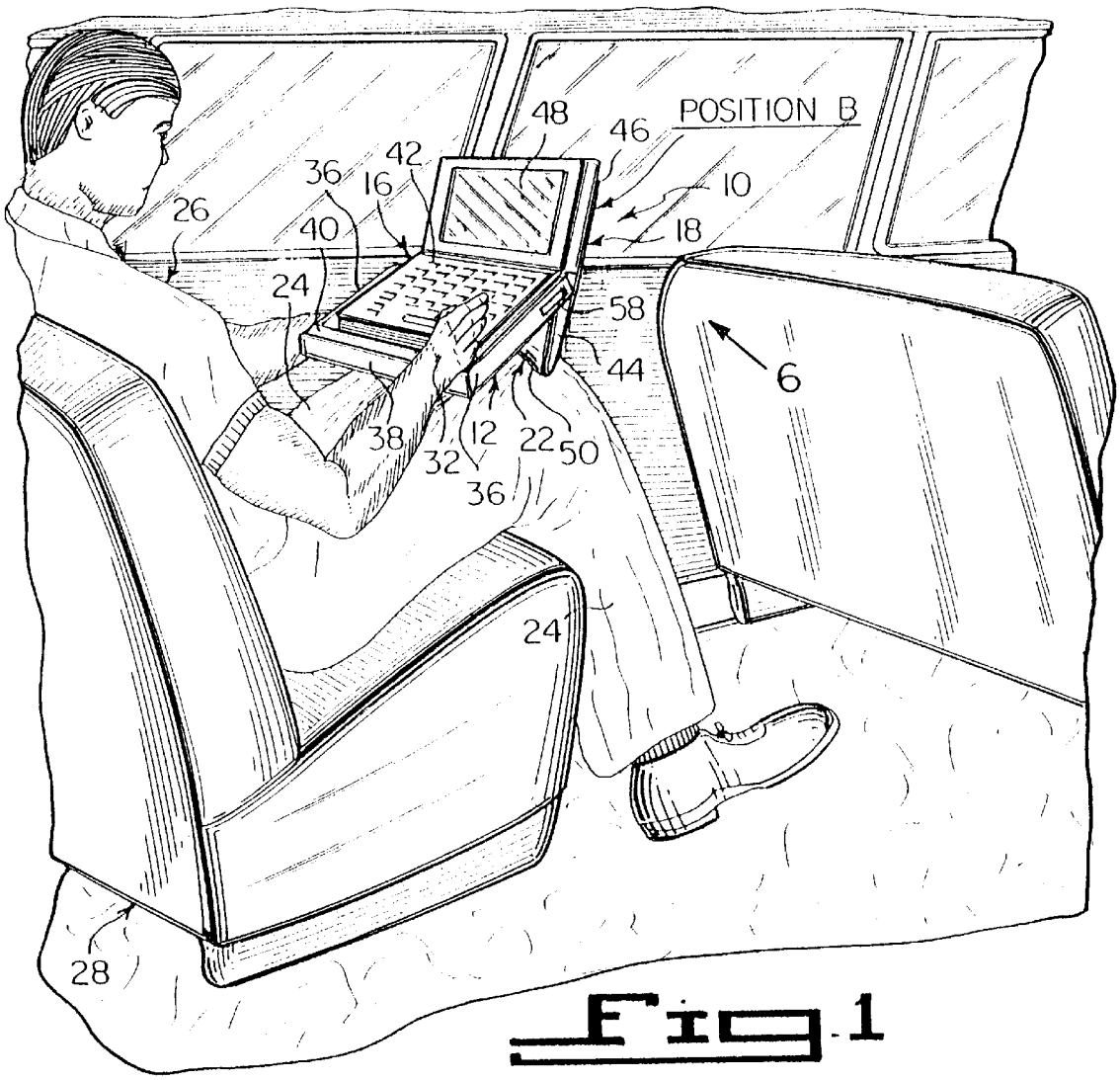
FIG. 1 is a front perspective view of the present invention opened, holding a laptop computer and placed upon the legs of a sitting person to function as a stand.
Figure 6:
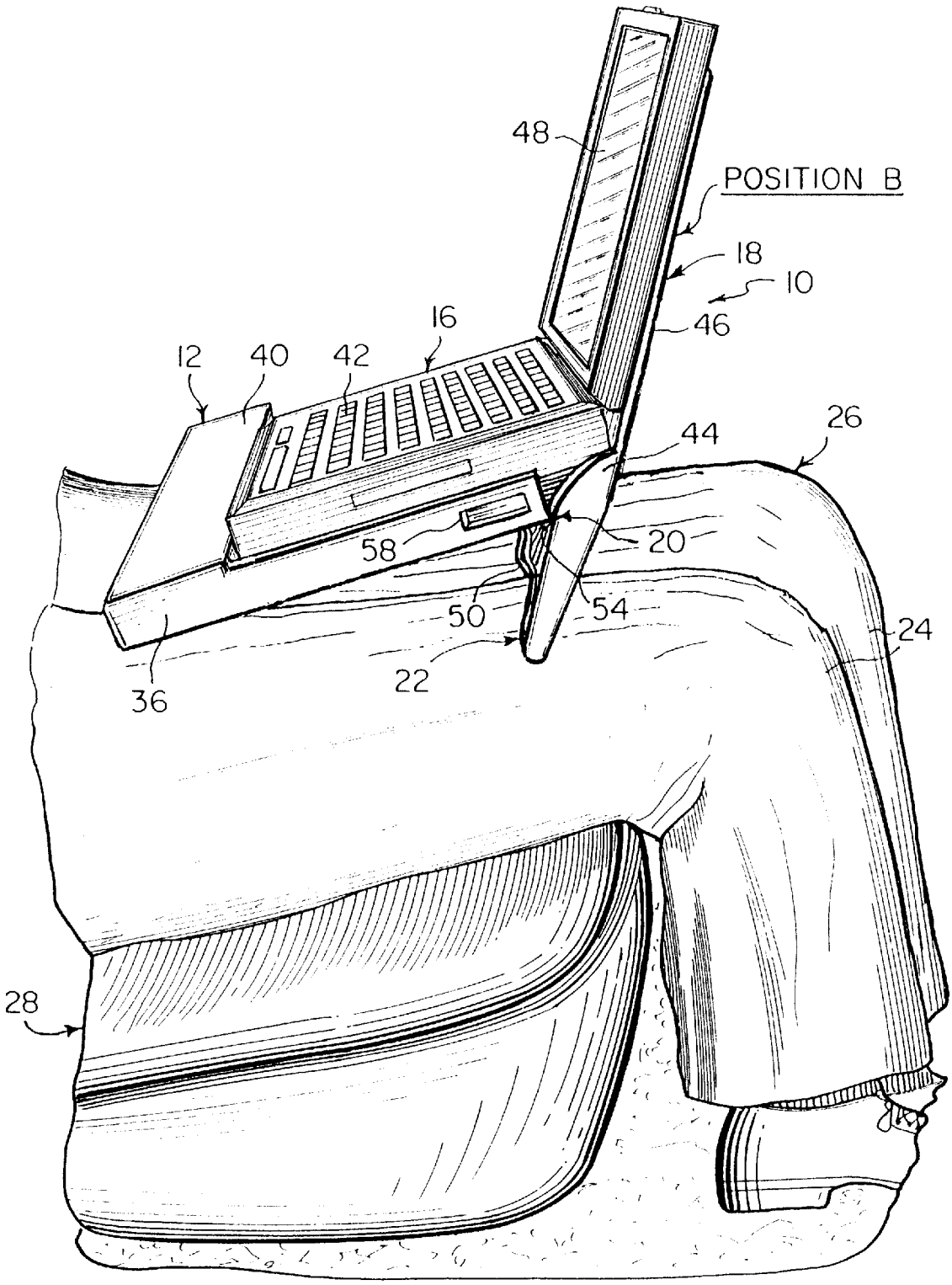

FIG. 6 is an enlarged side perspective view taken in the direction of arrow 6 in FIG. 1.

Similar reference characters denote corresponding features consistently throughout the attached drawings.

DESCRIPTION OF THE PREFERRED EMBODIMENTS

Turning now descriptively to the drawings, in which similar reference characters denote similar elements throughout the several views, FIGS. 1 through 6 illustrate the present invention being a laptop computer case and stand 10. With regard to the reference numerals used, the following numbering is used throughout the various drawing figures.

A ninety degree angle of 18
B one hundred and twenty degree angle of 18
10 laptop computer case and stand
12 base of 10
14 compartment in 12
16 laptop computer in 10
18 lid of 10
20 hinge between 12 and 18
22 leg engaging facility of 10
24 leg of 26
26 person
28 chair
30 transporting component of 10
34 bottom wall of 12
36 side wall of 12
38 front wall of 12
40 partial top wall of 12
42 keyboard of 16
44 hollow rear portion of 18
46 panel of 18
48 hinged display screen of 16
50 contour of 22 on 44
52 cutout carry handle of 30 in 44
52*a* strap handle of 30 on 44
52*b* shoulder strap of 30 on 44
53 hand of 26
54 living hinge of 20
56 latch mechanism between 12 and 18
58 aperture in 36
60 pocket on 62
62 inner surface of 46
64 computer disk in 60
66 VELCRO seal in 60
68 two-position retainer bracket of 10

The laptop computer case and stand 10 comprises a base 12 having a compartment 14, for holding a laptop computer 16 therein. A lid 18 is hinged at 20 to the base 12. A facility 22 along a rear edge of the lid 18 is for engaging an upper surface of a pair of legs 24 of a person 26 sitting in a chair 28, when the lid 18 is opened (see FIGS. 1 and 6). A component 30 adjacent the rear edge of the lid 18 is for transporting the base 12 and the lid 18 by the person 26, when the lid 18 is closed, so as to be conveyed to various locations (see FIGS. 2 and 2*a*).

The base 12 includes a bottom wall 34. A pair of side walls 36 extend from the bottom wall 34. A front wall 38 extends from the bottom wall 24. A partial top wall 40 is adjacent to the front wall 38 and extends between the side walls 36, so that a keyboard 42 of the laptop computer 16 can properly fit therein.

The lid 18 consists of a hollow rear portion 44. A panel 46 extends from the hollow rear portion 44 to support a hinged display screen 48 of the laptop computer 16, when the lid 18 is opened. The leg engaging facility 22 is a contour 50 formed along the rear edge of the hollow rear portion 44 of the lid 18, to properly fit upon the upper surface of the pair of legs 22 of the person 26 sitting in the chair 28 to prevent slippage.

The transporting component 30, as best seen in FIG. 2, is a cutout carry handle 52 formed within the hollow rear portion 44 of the lid 18 adjacent the rear edge thereof, so that a hand 53 of the person 26 can hold onto the cutout carry handle 52 when the lid 18 is closed. The transporting component 30, as shown in FIG. *2a*, can be a strap handle 52*a* mounted onto the rear edge of the hollow rear portion 44 of the lid 18, so that the hand 53 of the person 26 can hold onto the strap handle 52*a* when the lid 18 is closed. The transporting component 30, as shown in FIG. 2*a*, can also be a shoulder strap 52*b* mounted to opposite side edges of the hollow rear portion 44 of the lid 18, so that the shoulder strap 52*b* can be worn on a shoulder of the person 26, when the lid 18 is closed.

The lid 18 is hinged at 20 to the base 12 by a living hinge 54 extending thereacross. As best seen in FIG. 3, a pair of spaced apart latch mechanism 56 are between the base 12 and the lid 18, so as to lock the lid 18 closed upon the base 12. One of the side walls 36 of the base 18 has an aperture 58 therethrough, so that the keyboard 42 of the laptop computer 16 can be connected to a telephone line without being removed therefrom.

The laptop computer case and stand 10 shown in FIG. 5, contains a pocket 60 attached to an inner surface 62 of the panel 46 of the lid 18, to hold computer disks 64 papers and files therein. A hook and loop (VELCRO) seal 66 is between an open top of the pocket 60, so that when the lid 18 is closed the VELCRO seal 66 will prevent the computer disks 64, papers and files from falling out of the pocket 60.

A two-position retainer bracket 68 is between one side wall 36 of the base 12 and the lid 18. In a first instance, the lid 18 can be retained by the retainer bracket 68 at a ninety degree angle position "A" in FIG. 3, to sit upon a horizontal support surface. In a second instance, the lid 18 can be retained by the retainer bracket 68 at a one hundred and twenty degree angle position "B" in FIGS. 1, 3, 5 and 6, to engage the upper surface of the pair of legs 24 of the person 26 sitting in the chair 28.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A laptop computer case and stand comprising:

a) a base having a compartment for holding a laptop computer therein;

b) a lid hinged to said base;

c) means along a rear edge of said lid for engaging an upper surface of a pair of legs of a person sitting in a chair, when said lid is opened; and d) means on said lid for transporting said base and said lid by the person, when said lid is closed, so as to be conveyed to various locations.

2. A laptop computer case and stand as recited in claim 1, wherein said base includes:

a) a bottom wall;

b) a pair of side walls extending from said bottom wall;

c) a front wall extending from said bottom wall; and d) a partial top wall adjacent to said front wall and extending between said side walls, so that a keyboard of the laptop computer can properly fit therein.

3. A laptop computer case and stand as recited in claim 2, further including a two-position retainer bracket between one said side wall of said base and said lid, so that in a first instance said lid can be retained by said retainer bracket at a ninety degree angle to sit upon a horizontal support surface and in a second instance said lid can be retained by said retainer bracket at a one hundred and twenty degree angle, to engage the upper surface of the pair of legs of the person sitting in the chair.

4. A laptop computer case and stand as recited in claim 2, wherein one of said side walls of said base having an aperture therethrough, so that the keyboard of the laptop computer can be connected to a telephone line without being removed therefrom.

5. A laptop computer case and stand as recited in claim 1, wherein said lid includes:

a) a hollow rear portion; and b) a panel extending from said hollow rear portion to support a hinged display screen of the laptop computer when said lid is opened.

6. A laptop computer case and stand as recited in claim 5, wherein said transporting means is a strap handle mounted onto the rear edge of said hollow rear portion of said lid, so that a hand of the person can hold onto said strap handle when said lid is closed.

7. A laptop computer case and stand as recited in claim 3, wherein said transporting means is a shoulder strap mounted to opposite side edges of said hollow rear portion of said lid, so that said shoulder strap can be worn on a shoulder of the person when said lid is closed.

8. A laptop computer case and stand as recited in claim 5, wherein said leg engaging means is a contour formed along the rear edge of said hollow rear portion of said lid, to properly fit upon the upper surface of the pair of legs of the person sitting in the chair to prevent slippage.

9. A laptop computer case and stand as recited in claim 5, wherein said transporting means is a cutout carry handle formed within said hollow rear portion of said lid adjacent the rear edge thereof, so that a hand of the person can hold onto said cutout carry handle when said lid is closed.

10. A laptop computer case and stand as recited in claim 5, further including:

a) a pocket attached to an inner surface of said panel of said lid to hold computer disks, papers and files therein; and b) a hook and loop seal between an open top of said pocket, so that when said lid is closed said VELCRO seal will prevent the computer disks, papers and files from falling out of said pocket.

11. A laptop computer case and stand as recited in claim 1, wherein said lid is hinged to said base by a living hinge extending thereacross.

12. A laptop computer case and stand as recited in claim 1, further including a pair of spaced apart latch mechanisms between said base and said lid, so as to lock said lid closed upon said base.

13. A laptop computer case and stand as recited in claim 15, wherein said transporting means is a strap handle mounted onto the rear edge of said hollow rear portion of said lid, so that a hand of the person can hold onto said strap handle when said lid is closed.

14. A laptop computer case and stand as recited in claim 13, wherein said lid includes:

a) a hollow rear portion; and b) a panel extending from said hollow rear portion to support a hinged display screen of the laptop computer when said lid is opened.

15. A laptop computer case and stand as recited in claim 14, wherein said leg engaging means is a contour formed along the rear edge of said hollow rear portion of said lid, to properly fit upon the upper surface of the pair of legs of the person sitting in the chair to prevent slippage.

16. A laptop computer case and stand as recited in claim 15, wherein said transporting means is a cutout carry handle formed within said hollow rear portion of said lid adjacent the rear edge thereof, so that a hand of the person can hold onto said cutout carry handle when said lid is closed.

17. A laptop computer case and stand comprising:

a) a base having a compartment for holding a laptop computer therein, wherein said base includes a bottom wall, a pair of side walls extending from said bottom wall, a front wall extending from said bottom wall and a partial top wall adjacent to said front wall and extending between said side walls, so that a keyboard of the laptop computer can properly fit therein;

b) a lid hinged to said base;

c) means along a rear edge of said lid for engaging an upper surface of a pair of legs of a person sitting in a chair, when said lid is opened; and d) means on said lid for transporting said base and said lid by the person, when said lid is closed, so as to be conveyed to various locations.

18. A laptop computer case and stand as recited in claim 15, wherein said transporting means is a shoulder strap mounted to opposite side edges of said hollow rear portion of said lid, so that said shoulder strap can be worn on a shoulder of the person when said lid is closed.

19. A laptop computer case and stand as recited in claim 15, wherein said lid is hinged to said base by a living hinge extending thereacross.

20. A laptop computer case and stand as recited in claim 19, further including a pair of spaced apart latch mechanisms between said base and said lid, so as to lock said lid closed upon said base.

21. A laptop computer case and stand as recited in claim 20, wherein one of said side walls of said base having an aperture therethrough, so that the keyboard of the laptop computer can be connected to a telephone line without being removed therefrom.

22. A laptop computer case and stand as recited in claim 21, further including:

a) a pocket attached to an inner surface of said panel of said lid to hold computer disks, paper and files therein; and b) a hook and loop seal between an open top of said pocket, so that when said lid is closed said VELCRO seal will prevent the computer disks, papers and files from falling out of said pocket.

23. A laptop computer case and stand as recited in claim 22, further including a two-position retainer bracket between one said side wall of said base and said lid, so that in a first instance said lid can be retained by said retainer bracket at a ninety degree angle to sit upon a horizontal support surface and in a second instance said lid can be retained by said retainer bracket at a one hundred and twenty degree angle, to engage the upper surface of the pair of legs of the person sitting in the chair.

* * * * *